United States Patent [19]

Braun et al.

[11] 4,349,232

[45] Sep. 14, 1982

[54] TRENCH HEWING TOOL ASSEMBLY WITH CUTTER GUARD ATTACHMENT

[75] Inventors: Ernst Braun; Gert Braun, both of Essen-Heisingen; Karlheinz Wetzchewald, Essen-Kettwig, all of Fed. Rep. of Germany

[73] Assignee: Halbach & Braun, Fed. Rep. of Germany

[21] Appl. No.: 215,438

[22] Filed: Dec. 11, 1980

[30] Foreign Application Priority Data

Dec. 13, 1979 [DE] Fed. Rep. of Germany ..... 2950108

[51] Int. Cl.[3] ..... E21C 35/18

[52] U.S. Cl. ..... 299/92; 37/142 A; 407/115

[58] Field of Search ..... 299/91–93; 37/142 A, 142 R; 407/115, 116

[56] References Cited

U.S. PATENT DOCUMENTS

| | | | |
|---|---|---|---|
| 2,872,172 | 2/1959 | Fitzgerald | 299/93 X |
| 3,778,112 | 12/1973 | Krekeler | 299/92 X |
| 3,834,764 | 9/1974 | Krekeler | 299/92 X |
| 3,856,359 | 12/1974 | Krekeler | 299/92 |

FOREIGN PATENT DOCUMENTS

| | | | |
|---|---|---|---|
| 2419831 | 11/1975 | Fed. Rep. of Germany | 299/92 |

*Primary Examiner*—Ernest R. Purser

*Attorney, Agent, or Firm*—McGlew and Tuttle

[57] ABSTRACT

A trench hewing tool assembly comprises a cutting blade holder having a shank receiving opening and at least one retaining recess, a cutting blade having a shank disposed in the shank receiving opening, the shank having an inclined wall recess on one side thereof, and a cutting edge member connected to the cutting blade facing a hewing direction. A tapered clamping bolt is connected to the holder and spring loaded toward the blade shank to engage an inclined wall of the inclined wall recess to retain the blade in the holder. A projection is provided on the holder which is spaced from the cutting blade and a guard member has lateral legs which straddle the projection. The guard member includes at least one claw which is engaged on the retaining recess of the holder and has a locking groove in which is received the blade. The guard is held between the blade and the holder. The guard includes projections on either side of the blade receiving groove for guarding the holder and also for widening a cut made by the tool assembly in a lateral direction to prevent jamming of the holder.

6 Claims, 4 Drawing Figures

TRENCH HEWING TOOL ASSEMBLY WITH CUTTER GUARD ATTACHMENT

FIELD AND BACKGROUND OF THE INVENTION

The present invention relates in general to cutting tools and, in particular, to a new and useful trench cutting or hewing tool assembly particularly for cutting drums or cutting heads and the like of mine tools. The inventive arrangement is such that due to the interaction between a bearing surface and a clamping bolt of the tool on the one hand, and a backing by a cutter holder of a projecting portion provided between a cutter shank, on the other hand, a clamping force is produced by which the cutter is held fast substantially in the axial direction of the cutter shank. To change a cutter, the clamping bolt may of course be unlocked by means of a lever tool or the like which moves the clamping bolt.

Prior art tool assemblies of this kind (German AS 2,419,831) have proved satisfactory in operation. However, during the operation of the cutting tool, the cutter holder also is subjected to considerable abrasion due to its rough contact with the rock or coal to be cut or hewn. In other kinds of tool assemblies (German Pat. No. 1,298,480), it is known to equip the cutter holder with a guard. Such a guard is secured to the cutter holder by means of elements of its own, for example bores are provided extending perpendicularly to the cutting direction and receiving appropriate bolts or clamping sleeves. This is complicated. In addition, guards secured in this way frequently work loose since the clamping bolts or sleeves are subjected to shear forces and wear down the bores. This results in a premature destruction of the guard and the cutter holder, and in expensive repair work.

SUMMARY OF THE INVENTION

The present invention is directed to a further development of a tool assembly of the above-mentioned kind which prevents the cutter holder from being exposed to destructive abrasion. To this end and in accordance with the invention, the trench hewing tool assembly comprises a cutting blade holder having a shank receiving opening and at least one retaining recess, a cutting blade having a shank disposed in the shank receiving opening, the shank having an inclined wall recess on one side thereof, the cutting blade having a cutting edge member connected thereto facing a hewing direction, a tapered clamping bolt connected to the cutting blade holder extending into the inclined wall recess and bearing against an inclined wall of the inclined wall recess to retain the cutting blade in the shank receiving opening, the cutting blade holder having a projection extending therefrom spaced from the cutting blade, and a guard member having lateral legs straddling the projection and at least one claw engaging the retaining recess of the cutting blade holder, with the guard member having a locking groove receiving the cutting blade.

In a preferred embodiment of the invention, the arrangement and design is such that the cutter is locked between the clamping bolt and the guard, whereby the guad is clamped in place in a self-locking way.

With the invention design of the tool assembly, the guard intervenes to prevent the cutter holder from being exposed to the above-mentioned abrasion. The guard, however, may work as an additional, widening tool. For this purpose and according to a preferred embodiment of the invention, the trench hewing tool also includes guard projections which extend alongside the locking groove which receives the cutting blade, the guard projections having edges facing the hewing direction formed as cutting edges. These cutting edges as with the cutting edge member of the cutting blade are made of hardened material for example, carbide metal.

According to another feature of the invention, the guard projections include laterally extending enlargements of the cutting edge for cutting the sides of a trench to be cut by the trench hewing tools to enlarge the trench and prevent a jamming of the cutting blade holder and cutting blade. The tool holder may also be provided with such enlargements.

The inventive tool assembly has the advantage over the corresponding prior art that the cutter holder is no longer exposed to abrasive loads which would lead to a premature wear and destruction thereof. As compared to a similar device with a guard provided in other fields, the invention has the advantage that no particular securing means are needed for the guard. The component parts provided in the inventive design and the cutter itself additionally act as securing elements for the guard, and the manner of securing is such that in practice the guard cannot work loose. Its life then easily equals that of the cutter or cutting blade itself. At the time the cutter is changed, the guard also may be also exchanged without difficulties and particular expenses.

Accordingly, an object of the present invention is to provide a trench hewing tool assembly as set forth above and also one which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the following, one embodiment of the invention is explained in more detail with reference to the drawings in which.

DESCRIPTION OF THE PREFERRED EMBODIMENT

Figure 1:
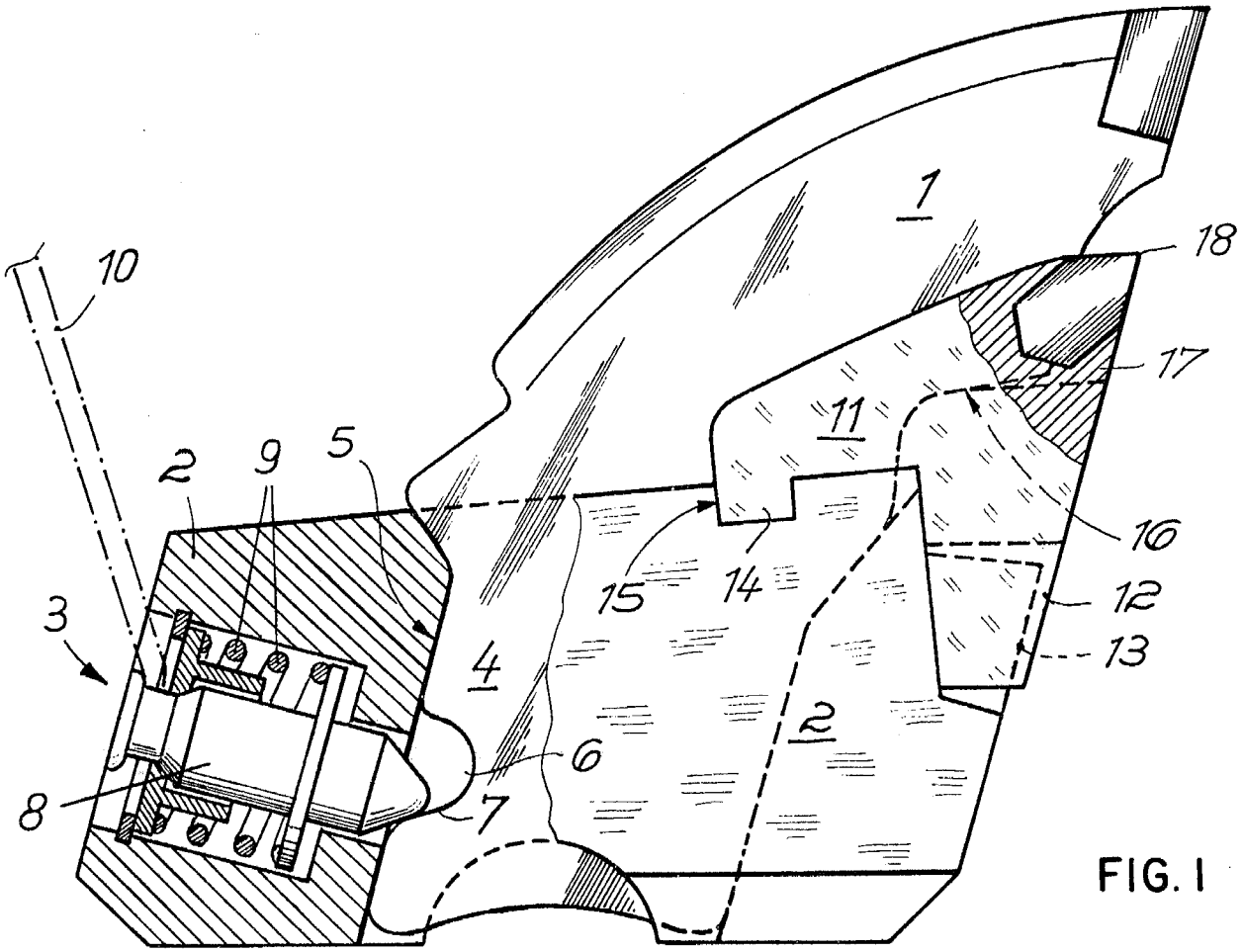
FIG. 1 is a side elevational view of an inventive tool assembly.

The tool assembly shown in the drawings is intended for trench hewing tools, particularly cutting drums, cutting heads, etc. for mines and the like. The direction of hewing is to the right as seen in FIG. 1. The tool assembly substantially comprises a cutter or cutter blade 1. A cutter holder 2 and a securing mechanism 3. As shown particularly in FIG. 1, cutter 1 is inserted by its shank 4 in a shank receiving slot 5 of cutter holder 2. Shank 4 is provided with a recess 6 having a slanting or inclined bearing surface or wall 7. In the adjacent portion of cutter holder 2, a clamping bolt 8 is mounted for engaging recess 6 and applying against oblique bearing surface 7. Bolt 8 is retractable, by means of a lever tool 10 or the like indicated in dotted lines in FIG. 1, against the action of a return spring 9, so that cutter 1 may be unlocked for changing. Lever 10 is first placed under the enlarged head of bolt 8 then moved clockwise to pull bolt 8 out away from recess 6.

Figure 2:
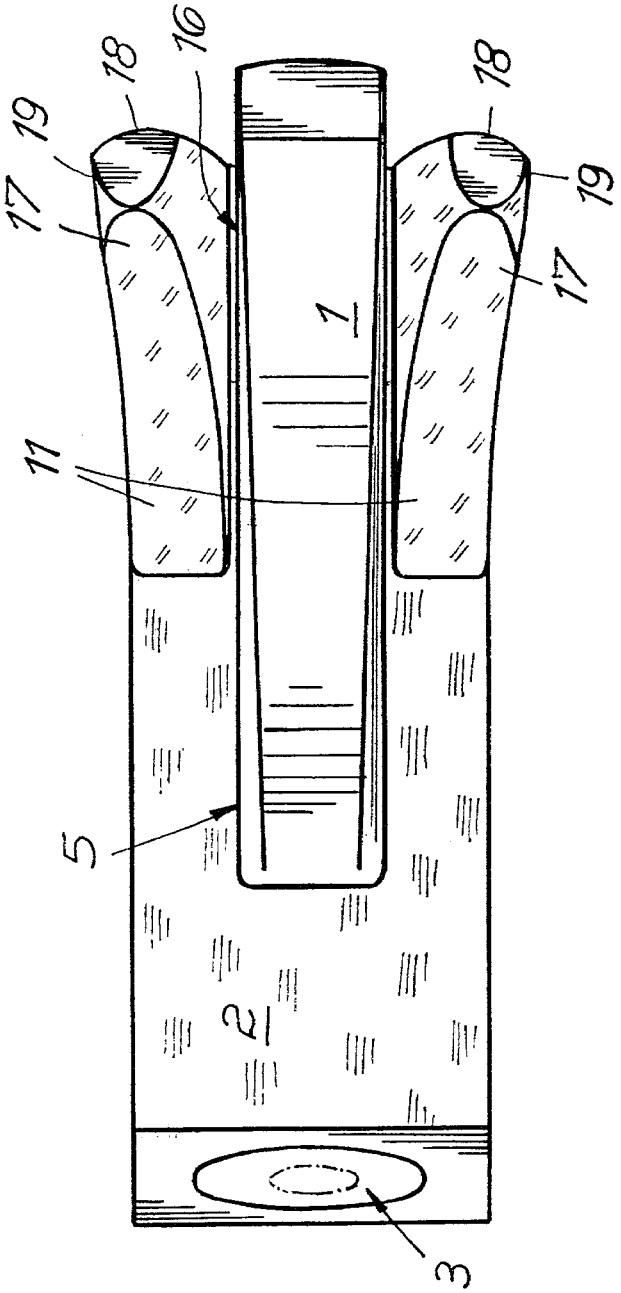
FIG. 2 is a top plan view corresponding to FIG. 1.
Figure 3:
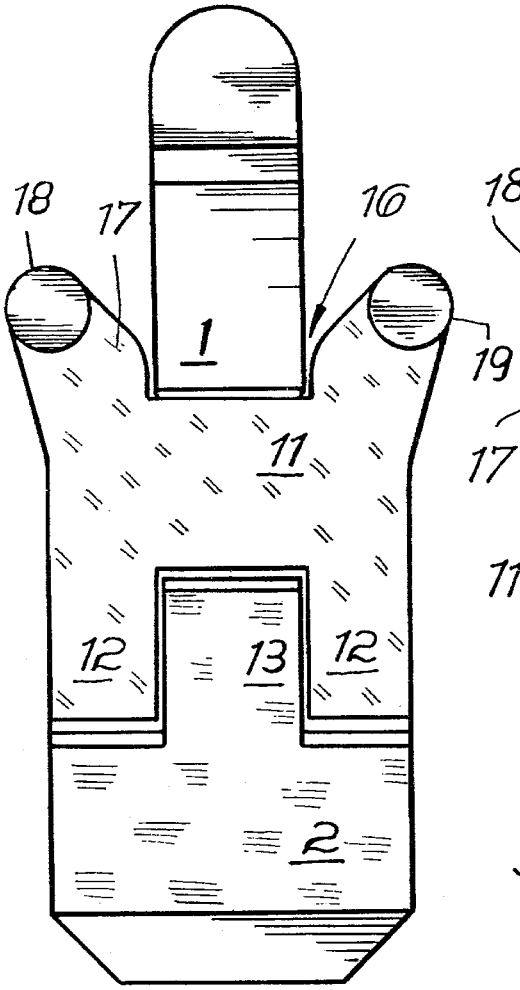
FIG. 3 is a corresponding front view.
Figure 4:
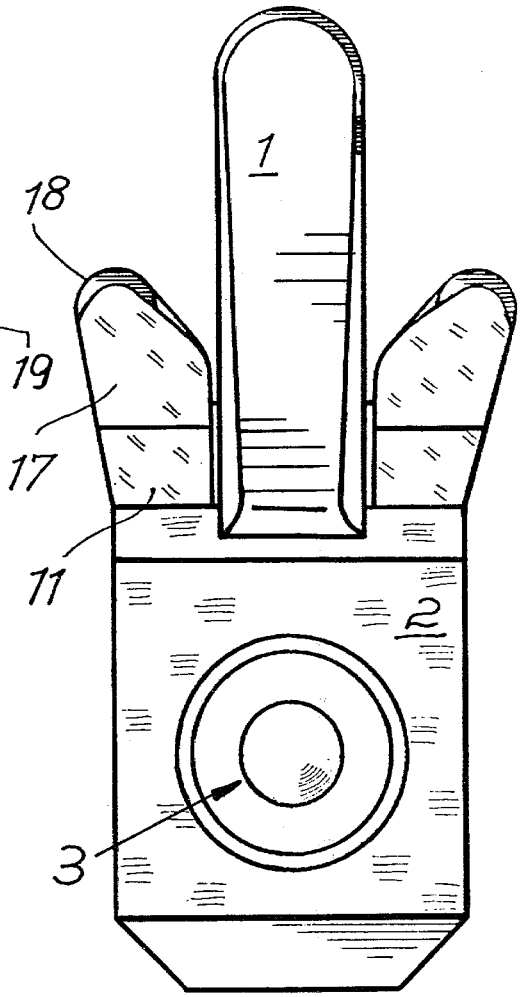
FIG. 4 is a corresponding rear view.

A guard 11 is provided between cutter 1 and cutter holder 2. By comparing FIGS. 1 and 3, it may be noted that guard 11 is placed by its two laterally extending legs 12 astride a projection 13 of the cutter holder 2. In addition, a retaining claw 14 of the guard is engaged in a retainer recess 15 of cutter holder 2, as shown in FIG. 1. Further, on its upper side, guide 11 has a locking groove 16 into which cutter 1 is engaged. A comparison of FIGS. 1 and 2 is instructive in this regard.

In the shown embodiment, the arrangement is such that cutter 1 is clamped between clamping bolt 8 and guard 11, so that the guard is clamped in place in a self-locking manner.

Further, in this embodiment, guard 11 performs an additional function as a tool for subsequently widening the cut in a trench. For this purpose, guard 11 is provided with projections 17 extending adjacent locking groove 16. Projections 17 have edges which face in the hewing direction and are designed as cutting edges 18 tipped with hard cabide metal or the like.

In the present embodiment, laterally extending enlargements 19 for cutting the tool free, are provided both on guard 11 and on holder 2 (only that on guard 11 is shown). This laterally enlarges the cut to prevent holder 2 from jamming.

While a specific embodiment of the invention has been shown and described in detail to illustrate the application of the principles of the invention, it will be understood that the invention may be embodied otherwise without departing from such principles.

What is claimed is:

1. A trench hewing tool assembly comprising:

a cutting blade holder having a shank receiving opening and at least one retaining recess;

a cutting blade having a shank disposed in said shank receiving opening, said shank having an inclined wall recess with an inclined wall on one side of said shank;

said cutting blade having a cutting edge member connected thereto facing in a hewing direction;

a tapered clamping bolt connected to said cutting blade holder extending into said inclined wall recess and bearing against said inclined wall of said cutting blade shank for retaining said cutting blade in said shank receiving opening;

said cutting blade holder having a projection extending therefrom spaced from said cutting blade; and a guard member having a lateral legs straddling said projection and at least one claw engaging said retaining recess of said cutting blade holder, said guard member having a locking groove receiving said cutting blade.

2. A trench hewing tool assembly according to claim 1, wherein said guard member is positioned on a side of said shank receiving opening opposite said clamping bolt and between said cutting blade holder and said cutting blade whereby said guard member is held in position by said cutting blade.

3. A trench hewing tool assembly according to claim 1, including guard projections extending from said guard member on either side of said locking groove having a cutting edge facing in the hewing direction.

4. A trench hewing tool assembly according to claim 3, wherein said cutting edge of said guard projection comprises carbide metal.

5. A trench hewing tool assembly according to claim 3, including enlargements extending laterally of the hewing direction for cutting a trench to prevent jamming of said cutting blade holder in the trench.

6. A trench hewing tool assembly according to claim 1, wherein said cutting blade holder has an opening therethrough communicating with said shank receiving openings, said clamping bolt slidably mounted in said opening and biasing means biasing said clamping bolt toward said shank receiving opening and into engagement with said inclined wall of said inclined wall recess.

* * * * *